United States Patent [19]

Summons et al.

[11] Patent Number: 4,899,909

[45] Date of Patent: Feb. 13, 1990

[54] MATERIALS CONTAINER WITH INDEX MARKINGS

[76] Inventors: Wayne L. Summons, 10778 Polar La., Littleton, Colo. 80125; Lester G. Burch, 8950 W. 87th Pl., Arvada, Colo. 80005

[21] Appl. No.: 242,363

[22] Filed: Sep. 9, 1988

Related U.S. Application Data

[62] Division of Ser. No. 895,128, Aug. 11, 1986, Pat. No. 4,776,458.

[51] Int. Cl.[4] ..... B67D 5/06; B67D 5/38

[52] U.S. Cl. ..... 222/25; 222/47; 222/158; 116/307; 116/321; 116/334

[58] Field of Search ..... 222/23, 25, 29, 41, 222/47, 51, 155, 158, 159; 116/334, 307, 321; 206/45.31, 45, 33, 459; 220/75, 76, 82 R, 453; 215/1 C

[56] References Cited

U.S. PATENT DOCUMENTS

| | | | |
|---|---|---|---|
| 2,981,449 | 4/1961 | Perkins | 222/541 |
| 3,297,207 | 1/1967 | Ballin | 222/158 |
| 3,363,811 | 1/1968 | Geist | 222/541 |
| 3,493,147 | 2/1970 | Ballin | 222/158 |
| 3,983,275 | 9/1976 | Winter et al. | 220/453 |
| 4,398,642 | 8/1983 | Okudaira et al. | 215/1 C |
| 4,604,307 | 8/1986 | Spreeuwers | 220/453 |
| 4,743,479 | 5/1988 | Nakamura et al. | 220/453 |

*Primary Examiner*—Joseph J. Rolla
*Assistant Examiner*—Steven M. Reiss
*Attorney, Agent, or Firm*—Timothy J. Martin; J. Preston Oxenham

[57] ABSTRACT

A container for viscous materials having volatile components is constructed to have a substantial transparency. The container includes a tubular housing having first and second closing structures at opposite ends. The housing may be entirely constructed of amorphous nylon, but preferably is formed as a laminate having a relatively thin inner lining of high barrier amorphous nylon and an outer sleeve of low barrier plastic, such as polyethylene teraphthalate. The container is adapted for caulking compounds wherein the first closing structure is an end wall, nozzle and snout assembly and wherein the second closing structure is defined by a movable piston slideably received in the housing interior. The transparent side wall of the housing and the snout are indexed whereby the snout is severed at a desired location, which determines the outlet size to inform the user of the length of the caulking bead that may be obtained from the contents remaining in the housing as shown by the position of the piston relative to the side wall indexing.

7 Claims, 1 Drawing Sheet

MATERIALS CONTAINER WITH INDEX MARKINGS

BACKGROUND OF THE INVENTION

This Application is a division of U.S. patent application Ser. No. 895,128 filed Aug. 11, 1986, now U.S. Pat. No. 4,776,458

The present invention relates to a materials container that is especially adapted as a container for those materials which have organic solvent components. The container is furthermore constructed to be substantially transparent to visible light along a transverse axis thereby resulting in a container that is both aesthetically pleasing and practical to use. In the past, materials having organic solvent components have commonly been packaged or stored in glass containers, metal containers or, in the case of viscous materials such as caulking, sealing and adhesive compounds, cardboard containers have been used for packaging and storage.

With respect to the containment of caulking compounds, the common method of packaging for commercial distribution is an elongated cardboard tube having a nozzle at one end and a moving piston at the other end. A disadvantage of such packaging is that the consumer cannot see the contents of the container. Further, during use, it is virtually impossible to accurately ascertain the volumetric contents of the container so that the user is often unaware as to how much material is available for application. Due to the differing weights of caulking materials, the purchase is also unable to ascertain whether or not the manufacturer has completely filled the caulking tube which shortfills inadvertently occur due to the cavitation of the highly viscous caulking compound.

While there has been a long felt need for a transparent container for materials containing organic solvent components, such containers have been generally unavailable with the exception of glass containers. Specifically, commonly available and inexpensive transparent plastics have a rather low barrier to vapor migration and are thus fairly permeable to organic solvents. Accordingly, it is both impractical and hazardous to package volatile materials in plastic containers. Recently, though, a high barrier transparent plastic material, called amorphous nylon, has been developed which material exhibits high resistance to vapor migration. The drawback of this material, though, is its extremely high cost as a potential packaging material.

Further, while the caulking industry has developed transparent caulking compounds such as silicones and block copolymer rubber (also known as the thermoplastic elastomers) that physically vulcanizes by molecular immobilization, it is difficult to convey to the consumer the transparent properties of such materials at the point of sale under current packaging techniques since the material is not visible though the opaque container. Further, the relative clarity between different "transparent" caulking compounds due to impurities, entrained air bubbles, and the like, cannot be readily shown to consumers for relative product comparison under current packaging techniques.

Accordingly, there is a general need for a container that is inexpensive in manufacture and which nonetheless is suitable for packaging materials having organic solvent components or other highly volatile components. There is a special need in the caulking industry for a transparent container which can suitably package caulking materials so that the materials may be visible to the consumer.

SUMMARY OF THE INVENTION

It is an object of the present invention to provide a new and useful container for materials containing highly volatile components, such as organic solvents.

It is a further objection of the present invention to provide a relatively inexpensive transparent container which does not undergo degradation when storing volatile materials and which does not pose a health hazard during long term storage of materials containing volatile components.

It is a still further object of the present invention to provide a transparent container suitable for caulking compounds which permits the consumer to view the contents of the container for fill volume, impurities, air bubbles and the like, and which container may be indexed in such a manner to allow the consumer to determine the amount of material remaining in the container even after using a portion thereof.

The present invention, therefore, specifically contemplates the construction of a container for viscous materials which are to be applied as a bead onto a surface wherein the container is adapted to permit visually monitoring of the contents thereof, and wherein the container is specifically adapted for holding and packaging materials having highly volatile components such as organic solvent. The present invention thus comprises an elongated tubular housing which has a hollow interior and a surrounding side wall which is fabricated of a transparent material. A nozzle member is secured at a downstream end of the tubular housing and includes an elongated snout which has a dispensing passageway therethrough. This passageway is in fluid communication with viscous materials contained in the interior of the tubular housing. The dispensing passageway varies in cross-section along its length so that the snout may be selectively severed to form a downstream outlet for the viscous materials which outlet has a selectively variable size and is initially isolated from the interior of the housing by a rupturable seal. The upstream end of the housing is enclosed by a piston member that is slideably received in the interior of the housing so that the piston member may be pressed against the viscous materials to force the materials out of the outlet as the piston member moves downstream through the housing. The positioned of the piston member within the housing allows the user to then visually perceive the remaining amount of viscous material through the side wall. Preferably, the side wall is indexed with first index markings and the snout is indexed with second index markings which are correlated to one another whereby, once the snout is severed to define a specific outlet size, the first index markings on the side wall correlate to inform the user as to the linear length of the bead which may be drawn from the container as a function of the remaining contents of the container. Preferably, the above container is fabricated of a high barrier plastic material and specifically contemplates the use of amorphous nylon in the side wall construction. Laminate layers may be employed, if desired.

These and other objects of the present invention will become more readily appreciated and understood from a consideration of the following detailed description of the preferred embodiment when taken together with accompanying drawings, in which:

DETAILED DESCRIPTION OF THE PREFERRED EMBODIMENT

The present invention is directed to a materials container particularly adapted to receive a viscous material containing organic solvent components, such as caulking compounds and the like. However, it should be appreciated that, in its broadest form, the present invention is adapted for and is useful as an inexpensive container or packaging for any highly volatile material which could otherwise be packaged in plastic. It is the purpose of the present invention to provide a container which may safely hold such a volatile material while, at the same time, allowing a purchaser or user visual perception of the contents.

Figure 1:
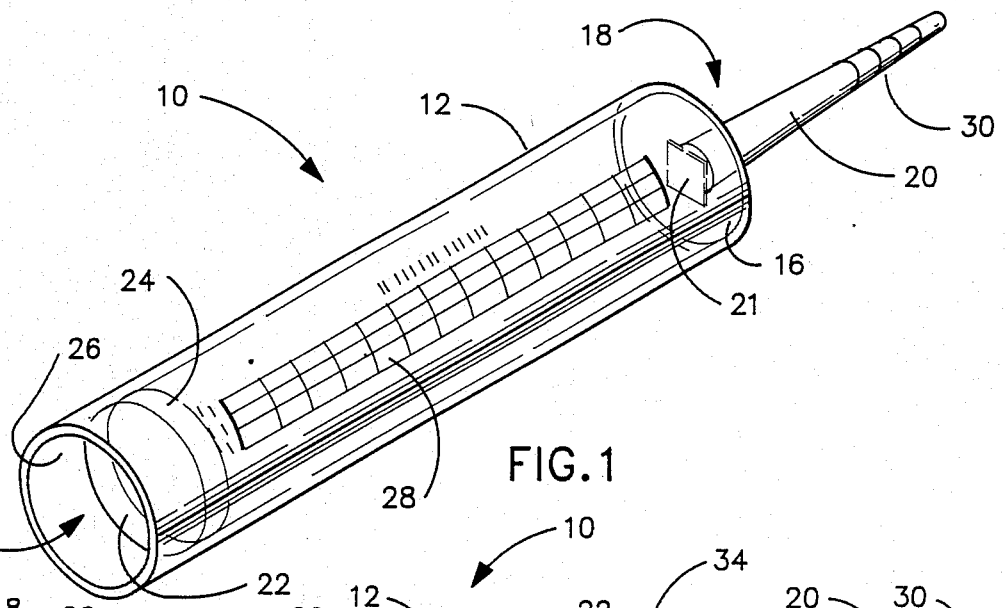
FIG. 1 is a perspective view of a materials container, in cartridge form, according to the preferred embodiment of the present invention.

In FIG. 1, the preferred embodiment of the present invention is shown as a caulking tube or container 10 in the form of an elongated tubular housing 12 which is preferably cylindrical in shape, but which could take a variety of cross-section geometric shapes, if desired. Tubular housing 12 has a generally hollow interior 14, and container 12 is closed at one end, by an end wall 16 including a nozzle assembly 18, as is known in the art. Nozzle assembly 18 includes an elongated dispensing snout 20. Housing 12 is enclosed at an end opposite end wall 16 by a piston member 22 which is slideably received in interior 14 so that it has a peripheral edge surface 24 that abuts the interior surface 48 of surrounding side wall 26 that forms tubular housing 12. As described more thoroughly below, side wall 26 is transparent and is provided with a set of index markings 28 which are correlated with index markings 30 on snout 20.

Figure 2:
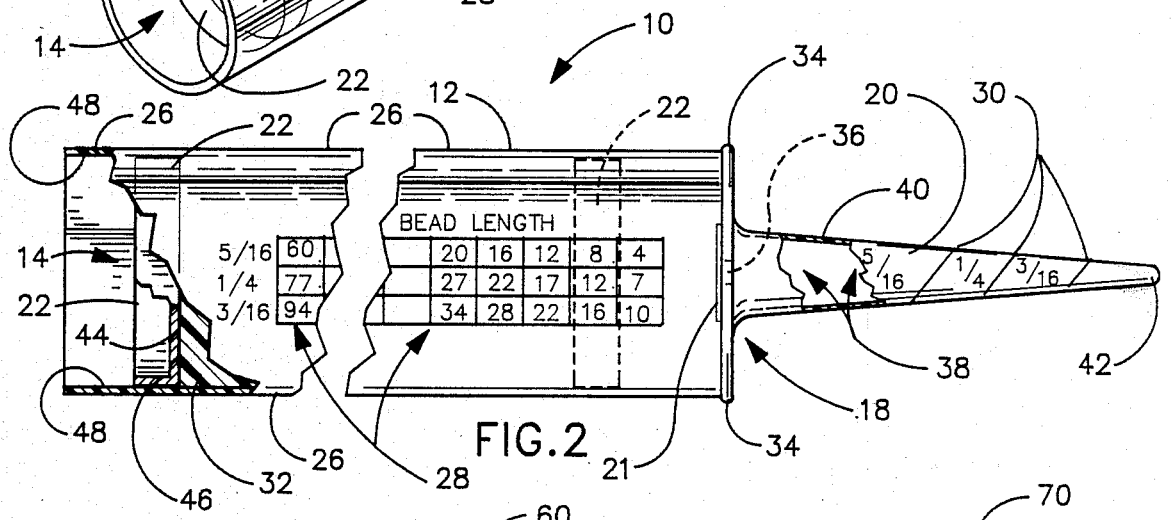
FIG. 2 is a side view in elevation, in partial cross-section and partially broken away, of the cartridge container shown in FIG. 1.

The construction of container 10 is shown in greater detail in FIG. 2. As is shown in FIG. 2, container 10 receives a caulking compound 32 which is preferably a clear, block copolymer rubber (thermoplastic elastomer) which physically vulcanizes by immobilization. Housing 12 is enclosed by end wall 16 which is preferably in the form of a metal cap having a lit 34 that is secured onto the edge of housing 12 as is known in the art. End wall 16 has a central port 36, shown in phantom, and is provided with nozzle assembly 18 that includes elongated snout 20. Snout 20 has a passageway 38 extending longitudinally therethrough with snout 20 being somewhat conical in shape so that side wall 40 of snout 20 diminishes in cross-section from end wall 16 to free end 42 of snout 20. Passageway 38 is in fluid communication with the interior 14 of housing 12, but, as is known in the art, a seal 21 interrupts this fluid communication. Prior to use, however, seal 21 is broken to establish the outlet path for the compound 32. The provision of seal 21 avoids the need for nozzle assembly 18 to be constructed of an impermeable material. In the preferred form of the present invention, snout 20 has index markings 30 which indicate a diametric size of caulking bead that will be drawn from snout 20 when snout 20 is severed at the corresponding index marking 30. Piston member 22, as is shown in FIG. 2, is cup-shaped in configuration so that it has a flat base plate 44 which bears against caulking material 32 when piston member 22 is slideably received in the open interior 14 of housing 12. To this end, piston member 22 has a side wall 46 which slideably engages interior surface 48 of side wall 26. Accordingly, the outer surface of side wall 46 defines peripheral surface 24 which slideably engages surface 48. It should thus be appreciated that, when snout 30 is severed at a selected location along its length, such as at index markings 30, a circular or oval outlet is formed for caulking material 32 since passageway 38 is in fluid communication with hollow interior 14 through port 36 in end wall 16. Accordingly, when piston member 22 is forcibly moved from the upstream location shown in FIG. 2 to the downstream location shown in phantom in FIG. 2, caulking material 32 is expelled as a rope-like bead from the outlet formed in snout 20. This rope-like bead has dimensions which correspond to the dimensions of the outlet. Index markings 30 are provided to indicate the diameter of the bead. Further, index markings 28 are provided on tubular housing 12 with index markings 28 being correlated to index markings 30 so that index markings 28 represent the linear length of the bead which may be drawn as a function of the outlet size registered by index markings 30. Since surrounding side wall 26 is transparent, the material which remains in cartridge 10 is defined by the position of base plate 44 so that the bead length may be determined from index markings 28 by viewing the position of plunger member 22 relative to index markings 28.

As noted above, it has not heretofore been acceptable to form tubular housing 12 out of existing transparent materials due to the fact that caulking compounds contain organic solvent components. Further, while it is within the scope of the present invention to form surrounding side wall 26 out of a unitary piece of high barrier transparent material which is impermeable to vapor migration, these materials, such as amorphous nylon, are cost prohibitive. Thus, there has been no suggestion that these materials are suitable in any form for packaging caulking compounds.

Thus, while the present invention recognizes that a unitary layer of amorphous nylon or other such material may be used in constructing side wall 26, the present invention is more particularly directed to the construction of a container out of laminate layers of various plastic materials so that the advantages of a high barrier material are obtained without the excessive costs concomitant with such materials.

To this end, FIGS. 3 through 7 show cross-sections of several embodiments of a laminated side wall construction out of which transparent side wall 26 may be fabricated. In order to provide a suitable vapor barrier for volatile materials, it has been found by the present applicants that amorphous nylon having a thickness of 0.005 inches or more is suitable for each of these embodiments.

The problem with such relatively thin layers of amorphous nylon, though, is that the thin layer does not have the structural rigidity to be suitable for packaging various materials, such as caulking compounds. Several inexpensive plastics have the structural rigidity suitable for packaging but are not high barrier materials so that they are not otherwise suitable for packaging caulking compounds. Accordingly, as is shown in FIGS. 3 through 7, the present invention provides a laminated side wall construction wherein an outer sleeve low barrier material has an inner liner of high barrier material, such as amorphous nylon.

Figure 3:
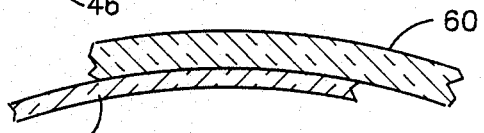
FIG. 3 is a cross-sectional view of the transparent side wall of the present invention according to one embodiment thereof.

In FIG. 3, outer sleeve 60 is formed of a relatively rigid, heat shrinkable plastic which may be heat-shrunk onto an inner liner 62 formed of amorphous nylon. Any other suitable frictional engagement of sleeve 60 with liner 62 is acceptable where the frictional engagement is such that the liner 62 and sleeve 60 may not be longitudinally moved relative to one another.

Figure 4:
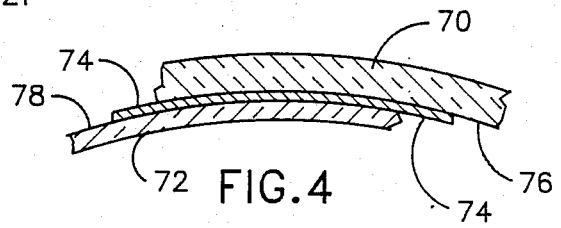
FIG. 4 is a cross-sectional view of the transparent side wall of the container according to the present invention showing a second embodiment thereof.

In FIG. 4, resistance to separation of outer sleeve 70 from inner liner 72 is accomplished by means of a clear adhesive material 74 which is placed between the facing surfaces 76 and 78 of sleeve 70 and liner 72, respectively.

Figure 5:
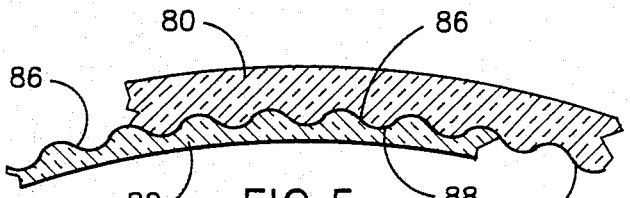
FIG. 5 is a cross-sectional view of the transparent side wall of the container according to the present invention showing a third embodiment thereof.

In FIG. 5, frictional engagement of outer sleeve 80 with inner liner 82 is enhanced by providing longitudinal corrugations on the facing surfaces 84 and 86 of outer sleeve and inner liner 82, respectively. As is shown in this figure, these corrugations are formed as matable ridges and valleys such as ridge 86 and valley 88 so that the surface area of; contact between outer sleeve 80 and inner liner 82 is greatly increased thereby resisting relative longitudinal separation of sleeve 80 and liner 82.

Figure 6:
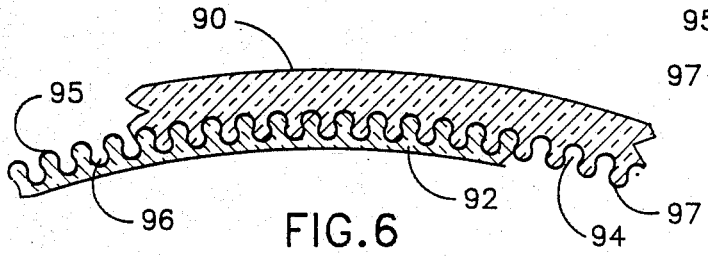
FIG. 6 is a cross-sectional view of the transparent side wall of the cartridge according to the preferred embodiment of the present invention showing a fourth embodiment thereof.
Figure 7:
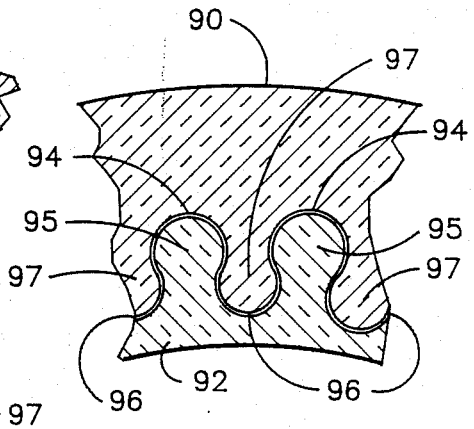
FIG. 7 is a magnified view of the micro-channels and micro-rib construction shown in FIG. 6.

FIGS. 6 and 7 show yet another embodiment wherein relative longitudinal separation is prohibited by mechanically bonding outer sleeve 90 to inner lining 92. Herein, interlocking micro-ribs and micro-channels are formed on the facing surfaces of sleeve 90 and lining 92. For example, micro-channels, such as channel 94 are formed with channel 94 having a width near its bottom wall which is greater than the upper channel opening into channel 94. A plurality of these channels are formed on the inner surface of sleeve 90 with these channels 94 receiving mating micro-ribs 95 formed on the outer surface of lining 92. Ribs 95 have substantially enlarged head portions so that, when ribs 95 are formed in an engaging relation with channels 94, they may not be withdrawn from the channel. Similarly, the outer surface of lining 92 has a plurality of micro-channels such as channels 96 which are positioned between ribs 95, and channels 96 receive corresponding micro-ribs 97 formed on the inner surface of sleeve 90. FIG. 7 shows an enlarged view of a single rib 95 engaging a channel 94 to interlock sleeve 90 and lining 92 together.

In order to provide sufficient resistance to volatile compounds while maintaining sufficient structural rigidity for a container, it has been found that the inner linings, such as linings 62, 72, 82 and 92, when formed of amorphous nylon, should have a thickness of at least 0.005 inches. Further, in order to provide the structural rigidity, the corresponding thickness of the outer sleeve, such as sleeve 60, 70, 80 and 90, should be in a ratio of at least 2½ times to 5 times thicker than the thickness of the inner lining. Further, in order to match the index of refraction of a clear caulking compound, such as the preferred silicone and block copolymer rubbers, it is preferable to have the outer sleeve fabricated of a clear plastic material having an index of refraction of approximately 1.45. To this end, suitable plastic, and that which is the preferred form of the present invention, contemplates the construction of the outer sleeve out of polyethylene teraphthalate.

According to the foregoing, it should be understood that the present invention contemplates the fabrication of a cartridge tube out of a clear material that has a high barrier resistance to vapor permeability so that the contents of the cartridge may be viewed and monitored as well as indexed as described above. Further, the invention specifically contemplates the laminating of a cartridge by fabricating a thicker outer shell of a relatively inexpensive material such as polyethylene teraphthalate onto a thinner lining of relatively thin amorphous nylon of sufficient thickness to provide a vapor barrier for a volatile compound placed in the cartridge. Further, the present invention thus contemplates a product for use in the building industry comprising a combination of transparent cartridge and a transparent caulking compound of either silicone or block copolymer rubber wherein the surrounding side wall preferably has an index of refraction of approximately 1.45 and which cartridge is provided with a traveling piston which forces the material out of the nozzle so that the entire cartridge and its contents are substantially transparent along a transverse axis of the cartridge.

The construction described above therefore allows a purchaser or user to observe the contents of a cartridge prior to purchase so as to observe any deficiencies of product, such as insufficient fill volume, entrained air bubbles, impurities or particulate matter, and it also allows the user or customer to view the color of an opaque caulking compound. Furthermore, the index marking permits the customer to calculate the number of cartridges needed in order to produce sufficient bead length for the job contemplated. Furthermore, such construction allows the manufacturer the ability for greater quality control of its product thereby maintaining the goodwill the manufacturer has built up with purchasers of its products.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A container for highly volatile viscous materials adapted to be applied as a bead onto a surface, said container adapted to permit visual monitoring of the contents thereof, comprising:

an elongated housing having a hollow interior and a tubular sidewall fabricated entirely out of a transparent material, an innermost portion of said sidewall radially facing the interior of the housing completely around said sidewall being composed of a high barrier plastic substance;

a nozzle member secured at a downstream end of said tubular housing and including an elongated snout having a passageway therethrough in fluid communication with the viscous materials contained in the interior of said tubular housing, said passageway varying in cross-section along its length whereby said snout may be selectively severed to form a downstream outlet for the viscous materials, said outlet thereby having a selectively variable size;

a piston member enclosing an upstream end of said tubular housing said piston member being slideably received in said interior so that the piston member may be pressed against the viscous materials to force the materials out of said outlet as said piston member is moved downstream through said tubular housing whereby the position of said piston member and the viscous material in said tubular housing may be visually perceived through said sidewall;

first index markings on said snout for indicating the size of the outlet formed when the snout is severed at a selected first index marking, and second index markings on said sidewall, said second index markings correlated to said first index markings whereby, for a selected first index marking, the second index marking and said piston of the piston member cooperate to indicate the linear length of the bead which maybe applied by the viscous material remaining in the housing.

2. A container according to claim 1 wherein said side wall is defined by an outer sleeve of a transparent plastic material and an inner lining of a high-barrier plastic.

3. A container according to claim 2 wherein said inner lining is amorphous nylon and said outer sleeve is polyethylene teraphthalate.

4. A container according to claim 3 wherein the ratio of the thickness of the inner lining to the thickness of the outer sleeve is approximately 1: x where $2.5 \leqq X \leqq 5.0$.

5. A container according to claim 4 wherein the thickness of the inner lining is at least 0.005 inches.

6. A container according to claim 2 wherein said outer sleeve is heat shrunk onto said inner lining.

7. A container according to claim 1 said plastic material is amorphous nylon.

* * * * *